United States Patent [19]

Amelung

[11] 4,186,457

[45] Feb. 5, 1980

[54] PEDIATRIC WATER MATTRESS

[75] Inventor: Robert J. Amelung, St. Louis, Mo.

[73] Assignee: Aqua-Babe Corporation, St. Louis, Mo.

[21] Appl. No.: 971,330

[22] Filed: Dec. 20, 1978

[51] Int. Cl.[2] ..... A47C 27/08; A61G 7/04

[52] U.S. Cl. ..... 5/452; 5/427; 128/1 R

[58] Field of Search ..... 5/450, 451, 452, 455, 5/480, 441, 425, 427; 128/1 R, 1 B

[56] References Cited

U.S. PATENT DOCUMENTS

| | | | |
|---|---|---|---|
| 3,722,012 | 3/1973 | Tobinick et al. | 5/451 |
| 4,048,684 | 9/1977 | Korner et al. | 128/33 |
| 4,149,286 | 4/1979 | Fogel | 24/201 C |

*Primary Examiner*—Alexander Grosz

*Attorney, Agent, or Firm*—Paul M. Denk

[57] ABSTRACT

In a pediatric water mattress, of the type for use for therapeutic purposes for enhancing the health attributes of an infant particularly after premature birth, the mattress incorporates a pair of inner liners that are sealed together around their perimeter to form a water holding chamber, a pair of outer liners, said outer liners being larger than the inner liners and forming a minor capacity air chamber in which the inner water chamber is located, a valve connecting through the lower outer and inner liners for providing access into the inner chamber for admission of water therein, with another valve connecting through the upper liner for providing access into the outer chamber for determining its contents, a covered guard means surrounding the mattress and being adhered coextensively with the outer periphery of the outer chamber, and an inflatable pillow formed for attachment upon the uppermost surface of the outer liner for providing comfort and therapeutic positioning of any infant resting upon the mattress.

9 Claims, 11 Drawing Figures

PEDIATRIC WATER MATTRESS

BACKGROUND OF THE INVENTION

This invention relates generally to the field concerning water beds, but more particularly pertains to a therapeutic water mattress for use in enhancing the survival, growth and health characteristics of a premature or new born infant.

Numerous styles of water mattresses are available in the prior art. Generally such mattresses have been primarily fabricated for use for domestic applications, providing an alternative to the customary fabricated spring type mattress now readily available and long used in the art. The water mattress, though, has been available for some time, and as explained in the United States patent to Calleance, U.S. Pat. No. 4,080,676, such constructions have been known for more than forty years. As shown in this cited patent, web portions may be joined together for forming substantially the basics of the water holding chamber for the mattress, but that such portions may be secured at particular locations for the purpose of further furnishing a rather noncompressible air chamber for use for integrally supplying a marginal rim around the periphery of the mattress. A similar type construction is also shown in the United States patent to Personett, U.S. Pat. No. 3,761,975.

Of more recent origin, though, has been the fabrication of water mattresses for use as a comfort cushion for infants, and in certain instances constructed as either an air or water, or combination of both, inflating means for furnishing both comfort and protection for the infant resting upon the same. In addition, the more recent art has given consideration to the therapeutic aspects of such cushions, and one such United States patent, as issued to Cummins, U.S. Pat. No. 4,066,072, discloses the fabrication of an infant supporting mattress that sustains pulsating fluids for the purpose of apparently simulating the infants environment to the prenatal conditions to which the fetus was exposed during pregnancy.

Similar type water bed structures, and for use by the infant, including those being treated as hospital patients, are shown in the two United States patents to Korner, et al, U.S. Pat. No. 4,084,684, and the United States patent to Shields, U.S. Pat. No. 3,766,579. As can be seen, various types of water bed constructions are disclosed generally incorporating water formed structures that cooperate with air formed beam means for furnishing a mattress or bed configuration.

The current invention recognizes the advancements made in the prior art, and improves upon certain other structures by incorporating additional features that provide for further and greater utility attainments through usage of the therapeutic type of water mattress, particularly for the infant, and even more especially for one that is prematurely born, while at the same time having inherent design features that facilitate the mass assembly and construction of the same.

It is, therefore, the primary object of this invention to provide especially a pediatric water mattress for use specifically for infant therapeutic purposes.

Another object of this invention is the provision of more solid type structure functioning as a barrier means around the circumference of the formed water mattress for the purpose of preventing the untimely and accidental removal of the infant from its prone position upon the mattress.

Another object of this invention is to provide a multi liner water mattress that incorporates an inner water chamber surrounded by a safety providing enveloping air chamber so as to insure that no accidental discharge or release of water will be exposed to the prostrated infant.

Another object of this invention is the provision of convenience means in the form of an air pillow, and a restraining strap, conveniently positioned upon the upper surface of the mattress so as to provide means for securing the infant in place upon the mattress, as through the strap, in addition to locating the pillow means for the comfort and therapeutic positioning of the infant rested thereon.

Yet another object of this invention is to provide improved safety in the application and usage of a pediatric water mattress through the application of various valves either for the purpose of filling its water chamber, or for determining when any leak may occur from the water segment chamber and into the contiguous chamber that surrounds the same.

Yet another object of this invention is to provide for the construction of the water mattress that may be used in conjunction with various hospital or other medical instrumentalities conveniently allowing for the installation of any associated electrical or other type cords into proximity of the infant resting prone upon the said mattress.

Still another object of this invention is to provide a system for the facile assembly of a pediatric water mattress that lessens the time and cost involved in the mass fabrication of the same.

These and other objects will become more apparent to those skilled in the art upon reviewing the summary of this invention, and upon undertaking a study of its preferred embodiment in view of its drawings.

SUMMARY OF THE INVENTION

As previously commented, water beds have been in use for quite some time, and it is of more recent origin that the principle of such construction has been found to be advantageous for therapeutic applications in the handling of infants, particularly those that are born prematurely. Findings from studies have demonstrated that the infants who are placed upon water beds exhibit a higher incident of what is defined as "quiet sleep" than infants who are handled upon the traditional mattresses. In addition, and findings derived through tests conducted upon the pediatric water mattress of this invention have disclosed that infants gain weight significantly better during their early days on this mattress than infants handled upon the conventional mattress. Furthermore, tests have also indicated that the changes in the head circumference is readily revealed within approximately two weeks from date of birth in a preterm infant prostrated upon the mattress of this invention, than those handled upon the usual pediatric ward mattress customarily found in the hospital. And, through repeated measurements of the factors surrounding quiet sleep, weight, and head circumference, tentative results indicate that significant differences are made in the patterns of change for infants treated upon the pediatric water mattress, such as defined in this invention, than those handled upon the conventional mattress. Thus, study results have indicated that the water bed environment is a beneficial way to provide patterned kinesthetic stimulation particularly for the preterm type infant.

Every infant must make some significant adaptations to the extrauterine life after delivery, and because of advances in medical techniques recently developed, more and more infants are surviving that critical transitional period after birth. These premature infants are frequently less well equipped than term infants to handle the adjustments necessary to survive in the extrauterine world because of the immaturity of their body systems. It can be readily understood that the extrauterine environment provided for the new infant, and particularly those that are prematurely born, is very much unlike the intrauterine environment to which they were exposed during the fetal stage. Thus, and as tests have indicated, as just previously summarized herein, there would appear to be a real need, and beneficial results that can be obtained therefrom, in providing a stimulating environment for preterm infants, such as an environment that fosters optimal growth and development for these infants. Since most of the kinesthetic stimulating in utero is probably transmitted via the infants contact with the amniotic fluid, and its movement sensations derived from the infants own movements, as well as due to its mother's positional changes, the desirable results obtained from stimulating such infants after their birth through their resting upon a water type mattress apparently stimulates these conditions to which the fetus was exposed to during pregnancy, and thereby normalizes its conditions to those which it had been previously conditioned. Thus, this probably affords some reason why infants subjected in the early days following delivery upon a water bed have responded more rapidly to the living environment than those premature babies treated normally upon the traditional type of mattress.

The hypothesis tested in comparing the use of a water mattress with the conventional mattress has indicated that the preterm infants who are exposed to a systematic program of kinesthetic stimulation, as through water bed flotation, demonstrate an increased growth in terms of weight when compared to the control group infants who are not exposed to such stimulation. Secondly, preterm infants who are exposed to the systematic program of kinesthetic stimulation, as through the water bed usage, demonstrates increased growth in terms of head circumference, as previously cited, when compared to infants who are not exposed to such kinesthetic stimulation have also demonstrated behavioral changes in terms of an increased incidence of calm sleep in relation to restless sleep in the early states of wakefulness when compared to a control group of preterm infants who are not exposed to such stimulation. Thus, the attributes obtained from usage of the water mattress in the pediatric ward has proven much more advantageous than any mattress of conventional construction that are customarily used currently by the hospital.

This invention contemplates the fabrication of the pediatric water mattress in a fashion that not only provides all of the attributes desired from such a mattress, but at the same time, furnishes that type of simulated stimulation as explained previously as a desirable result to be obtained from such a mattress particularly when utilized for the preterm infant, or for general use within the pediatric ward of the hospital. Furthermore, this invention is constructed to incorporate those safety features that are deemed desirable so as to prevent any mishap during usage of water as a cushioning for the infant in its bed, through the agency of providing a double reinforcement for the water chamber of the mattress construction which may yet even contain a slight quantity of air to function as a further cushion for the mattress.

This pediatric water mattress is constructed of a series of liners, two of which form the inner water chamber contained within its structure, while enveloping such formed water chamber with a pair of outer liners that form what may be defined as an air chamber, being of larger scope and size than the said water chamber, and thereby circumscribe the said inner disposed water chamber. These two chambers are moderately fixed together through the agency of a valve innerconnecting between both of the lower liners of the formed air and water chambers, thereby allowing direct access into the water chamber for achieving its fill when desired, or its emptying as when placed into nonuse. Another valve is provided through the top liner of the air chamber for allowing direct access into the same for the sake of inspection in the event that there is concern that water leakage may have occurred from the formed inner liner water chamber.

Since the outer chamber functions more in the nature of a safety chamber, its construction may be made from a polymer material that is of a thinner gauge than that forming the structured water chamber.

The tendency of an infant to move within its crib is readily apparent, even at the pediatric ward stage, and hence, a guard means in the form of a lined or covered polymer foam is integrally connected around the perimeter of the formed air chamber, having some height above the surface of the said chamber, so as to prevent the untimely self movement of the infant off of or against the mattress guard, which might otherwise occur and cause injury or suffocation to the child. Furthermore, and since there is some therapeutic value to maintaining the prone position of the infant during its early stages of life, a pillow means, being inflated with air or the like, is adhered at the approximate head location where the infant rests upon this water mattress, and is designed for adding to the comfort and therapeutic positioning of the infant thereon. In addition, a strap means is adhered at the approximate location of the infant's waist and is available for strapping the child in place so as to insure its sustained location at a particular position as desired for its period of rest or handling.

DESCRIPTION OF THE PREFERRED EMBODIMENT

Figure 1:
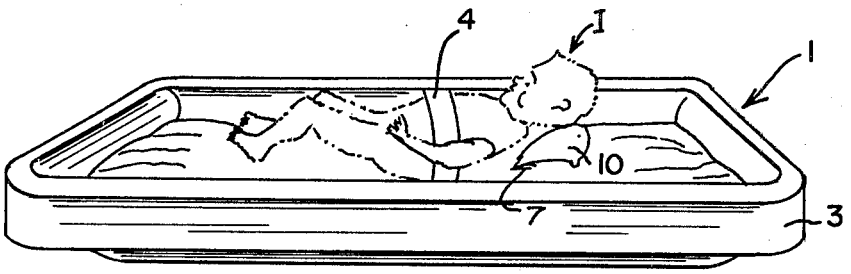
FIG. 1 discloses an isometric view of the pediatric water mattress of this invention, with an infant being retained in place thereon.
Figure 2:
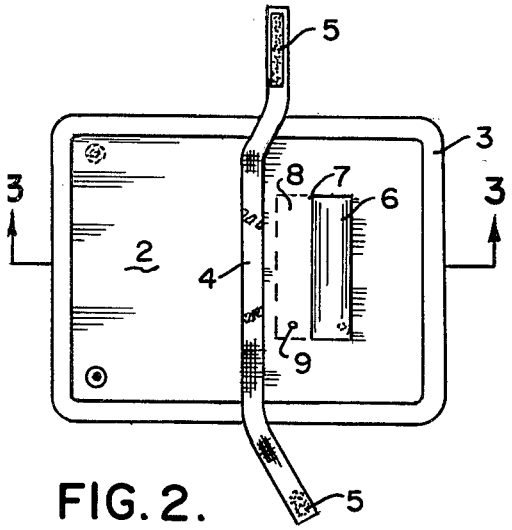
FIG. 2 discloses a plan view of the mattress of FIG. 1, with its strap being opened and the infant removed for clearer observation.
Figure 3:
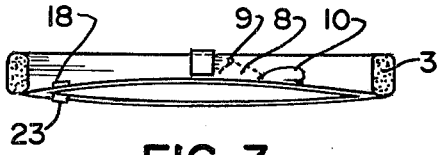
FIG. 3 provides a longitudinal view taken along the line 3—3 of FIG. 2.

In referring to FIGS. 1 through 3 of the drawings, there is disclosed the pediatric water mattress 1 of this invention, comprising a mattress portion 2 having a barrier or guard means 3 surrounding the same, so as to prevent the untimely self motivated movement of the infant from the mattress. Adhering to the top surface of the mattress portion 2 is a strap means 4, which has fastening means 5, such as Velcro, provided proximate its ends so as to furnish the means for securing the infant at a held position upon the mattress such as shown in FIG. 1. Furthermore, a pillow means 6 is furnished at the proximity of the infant's nape of neck or its head, and which pillow functions to maintain the comfort and therapeutic positioning of the infant, as in the latter case, for maintaining the esophagus open for ease of its breathing. The pillow means, its construction of which will be subsequently described, is sealed to the upper surface of the mattress portion along a connecting line, as at 7, as is generally initially installed in the broken line position as shown at 8, having its valve 9 conveniently exposed for inflating, and which pillow means 6 can then be folded over into its position of usage, as shown at 10 in FIGS. 1 and 3. The valve 9 may comprise a 450 AC Halkey Roberts valve, acquired from Halkey Roberts Corporation of Taramus, N.J.

Figure 4:
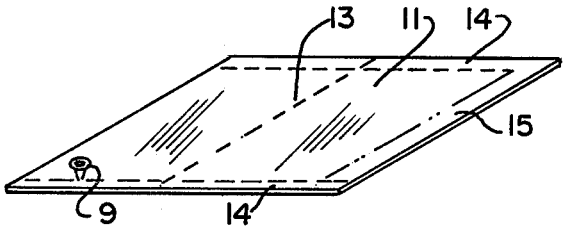
FIG. 4 discloses a sheet of film material prior to its assembly into the shape of the pillow means of this mattress.
Figure 5:
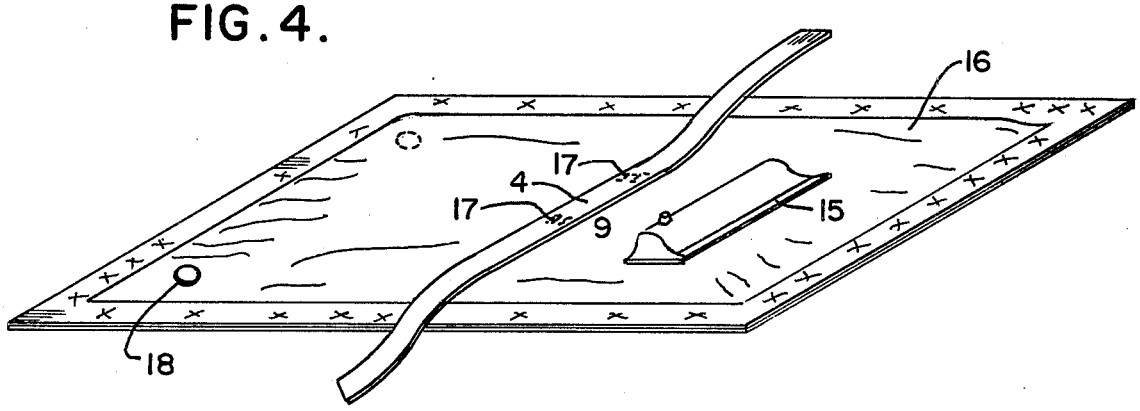
FIG. 5 discloses the deflated water mattress of this invention, with the peripheral barrier means not yet being applied thereto.

In the assembly of the pediatric water mattress of this invention, initially, and referring to FIG. 4, a section of frosty matt vinyl, such as polyvinyl chloride, and may be in the vicinity of a 0.015 to 0.020 inch gauge thickness, has an air valve, as at 9, positioned therethrough, and sealed in place, as through the use of a heat sealing process. The section to form the pillow is then folded over at approximately its midpoint, as along fold line 13, and then sealed around its perimeter as at the location of its marginal edges 14 and 15. The edge 15 extends slightly beyond the edge 14, and it is further heat sealed to the surface of an upper liner 16, being adhered along its flange 15 thereto, and in this position its valve 9 is disposed upwardly for direct access for effecting and inflating the pillow as desired. See FIG. 5. Then, the pillow may be flipped over into the position 10 as shown in use in FIGS. 1 and 3, as previously explained, and therein function as a rest for the head of the infant, if desired.

At this stage of the fabrication of this mattress, the strap 4 will be sealed to the upper surface of the liner 16, as along the points of adherence as shown at 17, and such connecting may be accomplished through the use of standard heat sealing process as is so customarily utilized in the attachment of polyvinyl materials together. In addition, a check valve 18, which may comprise a 650 AC air valve, as obtained from Halkey Roberts Corp., may be sealed through the said upper liner 16, and therein function as a safety check valve that allows access through the said liner for visually and physically inspecting the interior of the yet to be formed air chamber for the water mattress of this design. This liner 16 is also formed from polyvinyl, and may be approximately 0.010" to 0.020" inches thick.

Figure 6:
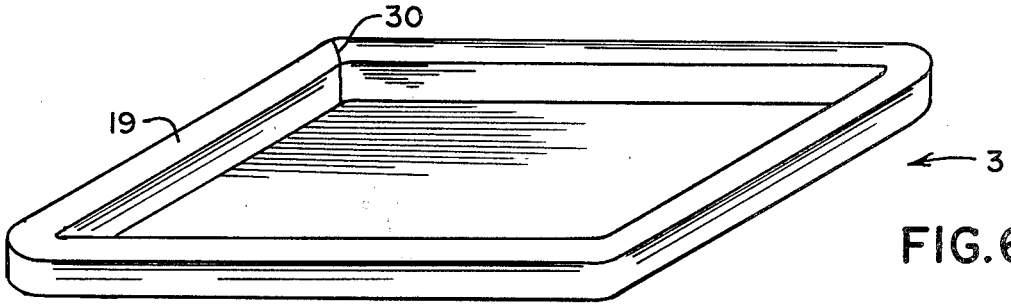
FIG. 6 discloses an isometric view of the polymer foam forming the interior structure of the peripheral guard or barrier means of this invention.
Figure 7:
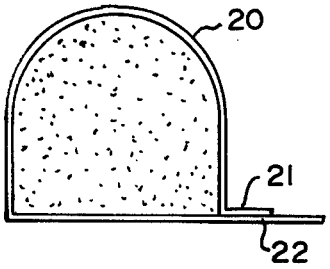
FIG. 7 discloses a cross sectional view of the fabricated guard means showing the foam material being encompassed by its covering.

The next stage of the fabrication of this mattress is the assembly of its guard means 3, which, as in its previous disclosure in FIG. 1, extends around the perimeter of the entire mattress. This means 3 is formed from a length of foam material, such as the foam polymer, or more specifically from a high density polyethylene foam that is shaped into the configuration of a safety edge for use in surrounding the periphery of the mattress, as aforesaid. See FIG. 6. Then, a covering material, such as an additional polyvinyl chloride liner material 20, is covered around foam 19, with its flanges 21 and 22 being secured, as by heat sealing, into place so as to furnish a more permanent shape to the configured guard edge.

Figure 8:
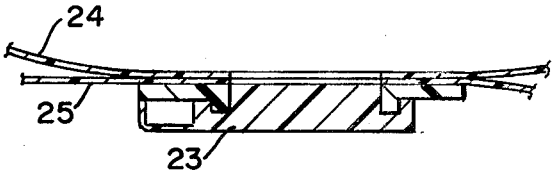
FIG. 8 shows a partial cross sectional view of the mattress depicting the attachment of the valve means through the lower air and water chamber liners.
Figure 9:
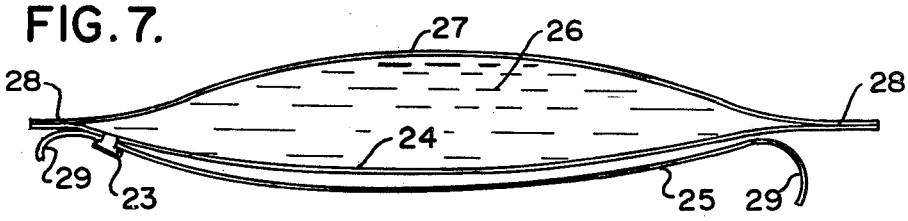
FIG. 9 shows a stage in the assembly of the water mattress of this invention wherein the water chamber has been fabricated, and with the valve means being connected through the water and air chamber liners.
Figure 10:
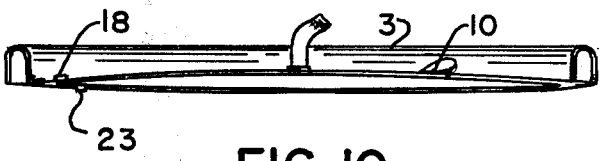
FIG. 10 provides a cross sectional view of the assembled mattress similar to that view shown in FIG. 3.

The next step in the procedure of fabricating this mattress is to install the water valve 23 through the bottom liners 24 and 25, of both the water and air chambers respectively, of this mattress, and as can be seen in FIG. 8, the valve is secured through both of these bottom liners so as to furnish direct access into the yet to be formed water chamber of the mattress so as to provide for its filling with water or other fluid, or discharge of the same as when the mattress is not used. Such a valve 23 may also be acquired from Halkey Roberts Corp., as aforesaid, and may comprise the No. 650 AC valve available from this source. When this procedure is performed, and as also can be seen from FIG. 9, the bottom liner 25, which may be approximately 0.010" thick, of the intended air chamber is then affixed to the underside of the lower liner 24, which may be approximately 0.017" thick, of the intended water chamber, and this water chamber 26 is then formed through the registration of an upper liner 27 thereon for the air chamber that is brought into alignment upon the liner 24, with its peripheral edge 28 then being secured, as through a heat sealing, so as to form a water-tight chamber that will hold a quantity of water therein, and resist leakage even when subjected any heavy usage. It is to be noted that the peripheral edges 29 of the lower liner 25 may be conveniently rolled back to provide direct access for the heat sealing machinery in its closure of the perimeter edge of the water chamber 26, so as to assure an adequate seal to the chamber.

Figure 11:
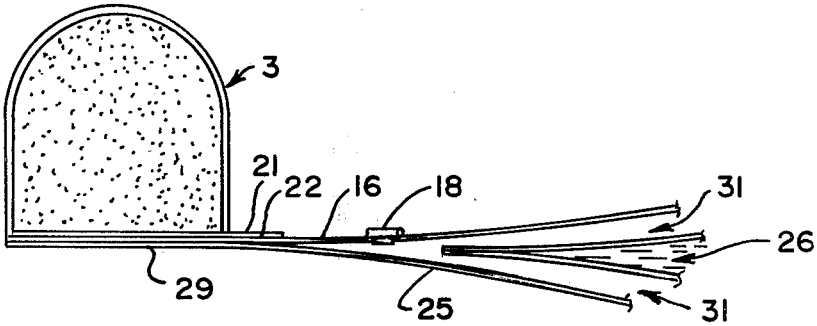
FIG. 11 depicts the securement of the guard means covering during its adherence with the outer perimeter of the air chamber liners.

Following the foregoing procedure, the previously shaped guard 3, the ends 30 of which will have been brought into securement with each other, as shown, is then rested upon the upper liner 16 that is intended to form the upper surface of the air chamber 31, and which combined guard means 3 and the liner 16 will be brought into registry upon the lower air chamber liner 25, in the vicinity of its said marginal edges 29, so that the flanges 22 and/or 21 of the said guard means can then be heat sealed permanently with the edges of the formed air chamber 31. In addition, the edges of the liners 16 and 25 may have previously been likewise heat sealed together, as shown in FIG. 11, so as to insure their hermetic retention together to prevent the escape of any air, but especially any fluid that may have been previously leaked from the water chamber 26. Furthermore, at least at one location, as at a corner location, the guard means 3, and more specifically its flanges 21 and 22, will remain unconnected with the peripheral edges 29 of liner 16 and 25, of the now formed air chamber 31, so that any instrumentation cords, tubes, or the like, as used in the pediatric ward, particularly where premature infants are cared for, may be inserted therethrough and conveniently held in place for furnishing a proper disposition of the medical instrument, such as an oxygen mask, and may be applied for treatment of the infant.

Although other forms of sealing or adhering means may be used for holding particularly the edges of the formed water and air chambers, where the liner material forming these chambers is of a polymer, such as polyvinyl chloride, then preferably the thermal dielectrical method for forming heat seals is preferred, for furnishing the permanent connection of these perimeter edges together. Such is rather important particularly where a fluid other than air is used in such a mattress, and especially where the inner chamber acts as a depository for a supply of water in the pediatric water mattress. All materials utilized in the construction of this mattress should be FDA approved, and sanctioned for hospital and therapeutic usage.

Variations in the design of this mattress may occur to those skilled in the art upon reviewing subject matter of this invention. Such variations, if within the spirit of this invention, are intended to be encompassed by the scope of any claims to patent protection issuing hereon. The description of the preferred embodiment as set forth is intended for illustrative purposes only.

Having thus described the invention, what is claimed and desired to be secured by Letters Patent is:

1. A pediatric water mattress for infant therapeutic usage, comprising, a pair of inner liners sealed together around their periphery for forming an inner chamber and provided for holding a supply of water, a pair of outer liners also sealed together around their perimeter for forming an outer chamber and being larger than the pair of inner liners, said inner liners formed water chamber being located within the said outer chamber, said outer chamber arranged for holding some minimal quantity of air, a valve means connected through both an inner and outer liner for use for introducing a supply of water into the said inner chamber, a check valve connecting through the outer liner and for use for investigating the contents of the outer air chamber, and guard means connecting around the perimeter of the said outer liner to restrain any infant located upon the mattress wherein said guard means extends upwardly above the said liner to which it attaches, and said guard means being coextensive with the perimeter of the liner to which it connects.

2. The invention of claim 1 and wherein said guard means comprises a length of foam polymer, and a covering of material surrounding said foam and attaching with at least one of said outer liners.

3. The invention of claim 1 wherein said foam polymer comprises polyethylene.

4. The invention of claim 3 and wherein said guard means covering material and the inner and outer liners are formed of polyvinyl chloride.

5. The invention of claims 1 or 4 and wherein said inner liners are formed of thicker gauge material than the said outer liners.

6. The invention of claim 1 and including a pillow means provided upon the upper exposed outer liner, said pillow means providing for the comfort and therapeutic positioning of any infant thereon.

7. The invention of claims 1 or 6 and including strap means securing to the uppermost disposed outer liner, fastening means provided upon said strap means and designed for fastening around the infant to maintain its sustained positioning upon the mattress.

8. The invention of claim 7 and wherein said pillow means is formed from a singular sheet of liner material, said sheet being folded over into edge alignment and sealed along its aligned edges, one of said sealed edges being adhered to the upper surface of the outer liner, and valve means provided through the pillow means to allow for its inflation.

9. The invention of claim 1 and wherein the guard means and the liner means are unconnected at least at one location to provide clearance for insertion of any wiring or the like therethrough.

* * * * *